US005505224A

United States Patent [19]

Urrutia et al.

[11] Patent Number: 5,505,224

[45] Date of Patent: Apr. 9, 1996

[54] DEVICE FOR CONTROLLING PISTON DISPLACEMENT AND PUMP INCLUDING SAME

[75] Inventors: Stéphane Urrutia, Bordeaux; Michel Saubade, Blasimon, both of France

[73] Assignee: Societe Civile de Recherche ODY, France

[21] Appl. No.: 264,299

[22] Filed: Jun. 23, 1994

[30] Foreign Application Priority Data

Jul. 5, 1993 [FR] France ..... 93 08178

[51] Int. Cl.[6] ..... F04B 13/02; G05D 11/03

[52] U.S. Cl. ..... 137/99; 417/403; 91/229

[58] Field of Search ..... 417/403; 137/99; 91/229

[56] References Cited

U.S. PATENT DOCUMENTS

| | | | |
|---|---|---|---|
| 4,621,747 | 11/1986 | van der Velde et al. | 137/99 X |
| 4,756,329 | 7/1988 | Cloup | 137/99 |
| 4,809,731 | 3/1989 | Walton et al. | 137/99 |
| 4,832,071 | 5/1989 | Rehfeld | 137/99 |
| 5,137,435 | 8/1992 | Walton | 417/403 |
| 5,234,322 | 8/1993 | Daniels et al. | 417/403 |
| 5,244,361 | 9/1993 | Solomon | 417/403 |

FOREIGN PATENT DOCUMENTS

| | | |
|---|---|---|
| 0255791A1 | 2/1988 | European Pat. Off. . |
| 0507071A1 | 10/1992 | European Pat. Off. . |
| 2205361 | 5/1974 | France . |
| WO88/09006 | 11/1988 | WIPO . |

*Primary Examiner*—Richard E. Gluck

*Attorney, Agent, or Firm*—Pollock, Vande Sande & Priddy

[57] ABSTRACT

The device (D) for controlling the reciprocating displacements of a differential piston (1) includes at least one valve associated with each of the parts of different cross-sections of the piston (1), and a rocker mechanism (B) urged by a spring in a direction transverse to the direction of displacement of the piston (1). The rocker mechanism (B) is designed to control the valves in closure and/or opening at each end of stroke in order to reverse the movement of the piston (1); a push rod (55) is mounted so that it slides relative to the piston (1), whilst being able to be driven by this piston, the push rod being capable of coming to bear, at each end of stroke, against a limit stop (s, 14*a*) connected to the enclosure, in order to give rise to the rocking of the mechanism (B). The rocker mechanism (B) is arranged in order to provide internal takeup of the transverse forces of the elastic means (44) and in order to transmit to the push rod (55) solely forces which are substantially parallel to the direction of displacement of this push rod (55).

13 Claims, 3 Drawing Sheets

DEVICE FOR CONTROLLING PISTON DISPLACEMENT AND PUMP INCLUDING SAME

The invention relates to a device for controlling the reciprocating displacements of a differential piston including two parts of different cross-sections, this piston being capable of being displaced in an enclosure including two cylinders respectively associated with each part of the piston, the enclosure being equipped with an inlet for driving fluid connected to one of the cylinders and with an outlet connected to the other cylinder, the control device including at least one valve associated with each of the parts of different cross-sections of the piston, and a rocker mechanism urged by a spring in a direction transverse to the direction of displacement of the piston, this rocker mechanism being designed to control the valves in closure and/or opening at each end of stroke in order to reverse the movement of the piston, a push rod being mounted so that it can slide relative to the piston, whilst being able to be driven by this piston, the push rod being capable of coming to bear, at each end of stroke, against a limit stop connected to the enclosure, in order to give rise to the rocking of the mechanism.

A device of this sort is known from FR-A-2,205,361. The rocker mechanism comprises a tension spring fastened, at one end, to a point of the sliding push rod which is thus subjected to transverse forces which are detrimental from the point of view of providing sealing as well as from the point of view of sliding and wear.

The object of the invention, above all, is to provide a control device of the sort defined previously, in which parasitic friction on the push rod is reduced as far as possible. It is furthermore desirable for the device to remain of simple and robust construction and to be of reliable operation.

According to the invention, a device for controlling the reciprocating displacements of a differential piston including two parts of different cross-sections, this piston being capable of being displaced in an enclosure including two cylinders respectively associated with each part of the piston, the enclosure being equipped with an inlet for driving fluid connected to one of the cylinders and with an outlet connected to the other cylinder, of the sort defined previously, is characterized in that the rocker mechanism is arranged in order to provide internal uptake of the transverse forces of the elastic means and in order to transmit to the push rod solely forces which are substantially parallel to the direction of displacement of this push rod.

Advantageously, the rocker mechanism comprises a first link rod means articulated at one end to a pivot connected to the piston, the other end of this link rod means being connected to one end of the said spring, and a second link rod means, one end of which is articulated to a second pivot connected to the piston but situated at a distance, in a transverse direction with respect to the direction of sliding of the push rod, away from the first pivot, the other end of this second link rod means being connected to the other end of the said spring and being capable of rocking between two rests connected to the piston, situated on either side of the first pivot in the direction of sliding of the push rod.

Preferably, the rocker mechanism is connected to the push rod by a simple rest means. This rest means advantageously comprises, on the mechanism side, a bar substantially orthogonal to the direction of displacement of the push rod and, on the push rod side, a housing open in a direction orthogonal to the direction of displacement of the push rod and capable of receiving the bar.

Preferably, a sleeve is fixed to the push rod, particularly by crimping, and the abovementioned housing is provided in this sleeve.

The first link rod means preferably comprises two parallel branches far apart from each other, between which branches is mounted the second link rod means, the ends of the branches away from the pivot being connected by the bar engaged in the abovementioned housing, the spring being fastened, at one end, to the said bar and, at its other end, to another bar carried by the second link rod means.

This second link rod means is advantageously likewise formed by two parallel branches, which are less far apart than those of the first link rod means, the said branches, at their end away from the pivot, carrying the bar to which the other end of the spring is fastened.

Preferably, the spring comprises two elementary springs, mounted in parallel between the branches of the first and of the second link rod means.

The differential piston preferably comprises a central part bounded by a cylindrical hollow portion and an annular part. The pivots of the link rod means are advantageously carried by a component forming a sort of diametral portal frame, fixed to the upper part of the piston and including a bearing for each pivot.

The valves are advantageously mounted on gear connected, by a linking member, to the second link rod means.

Elastic compensation means are advantageously placed between the valves and the parts of the gear driving these valves, so that the gear can benefit from a dead travel while the valve is in abutment in its closed position.

The invention also relates to a metering pump capable of injecting an additive product into a liquid, this metering pump including a differential piston, the reciprocating displacements of which are controlled by a device as described previously, this differential piston being capable of actuating the plunger of a pump for sucking up and delivering the additive.

The invention consists, apart from the arrangements expounded hereinabove, of a certain number of other arrangements which will be dealt with more clearly hereafter with regard to an embodiment example described with reference to the appended drawings, but which is in no way limiting.

FIG. 1 of these drawings is an axial vertical section, with parts as an external view, of a metering pump equipped with a device for controlling the reciprocating displacements of a differential piston in accordance with the invention.

Figure 3:
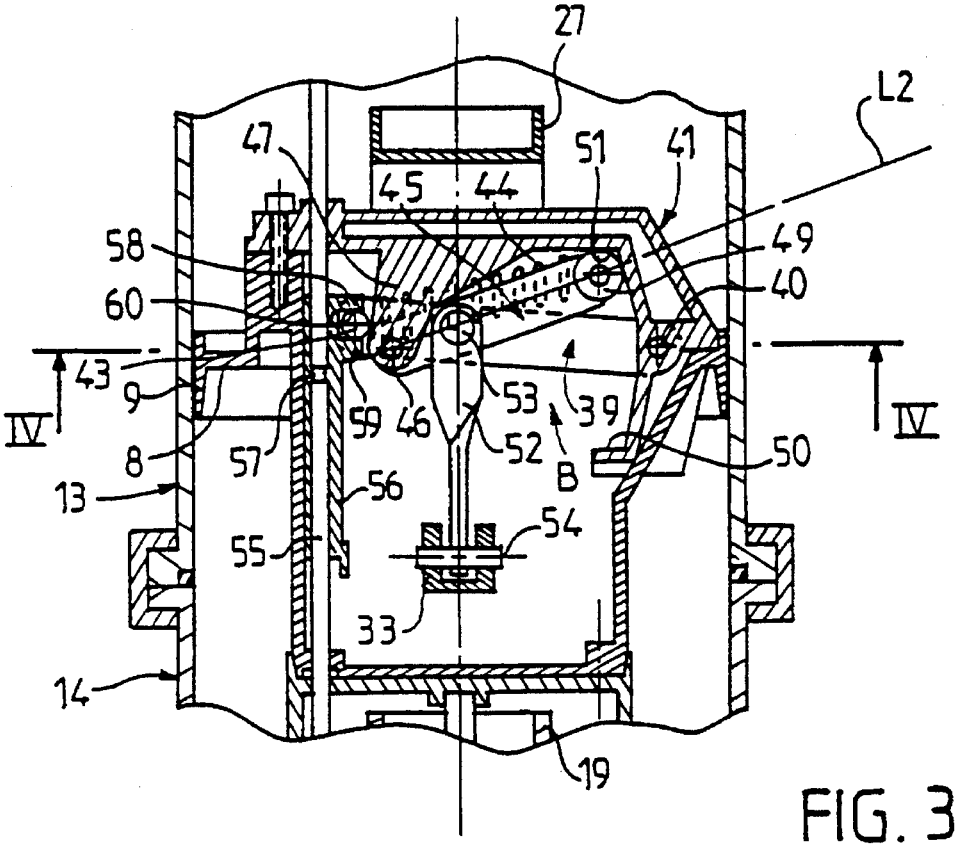
FIG. 3 is a partial section, similar to that of FIG. 1, but in another configuration of the rocker mechanism.
Figure 4:
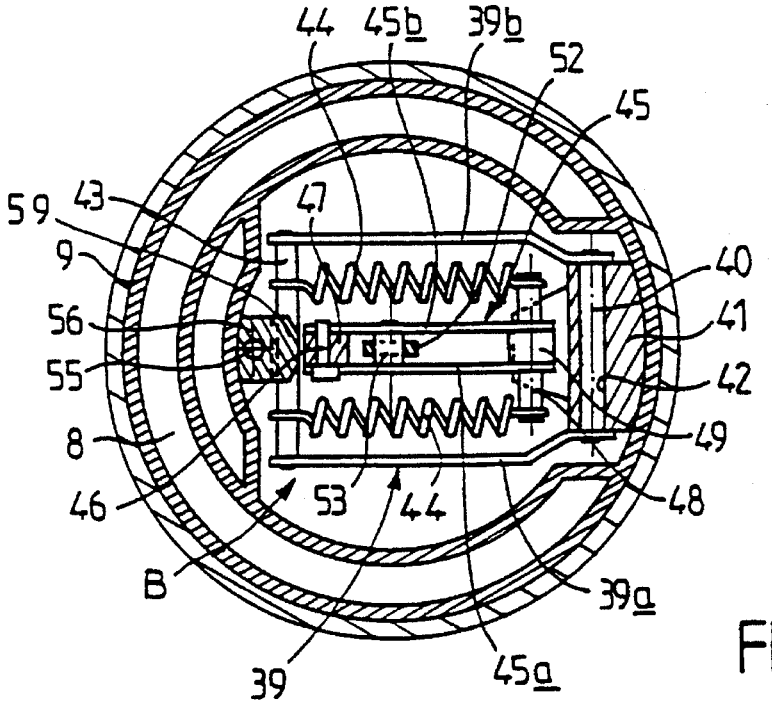

Finally, FIG. 4 is a section on the line IV—IV of FIG. 3.

Figure 1:
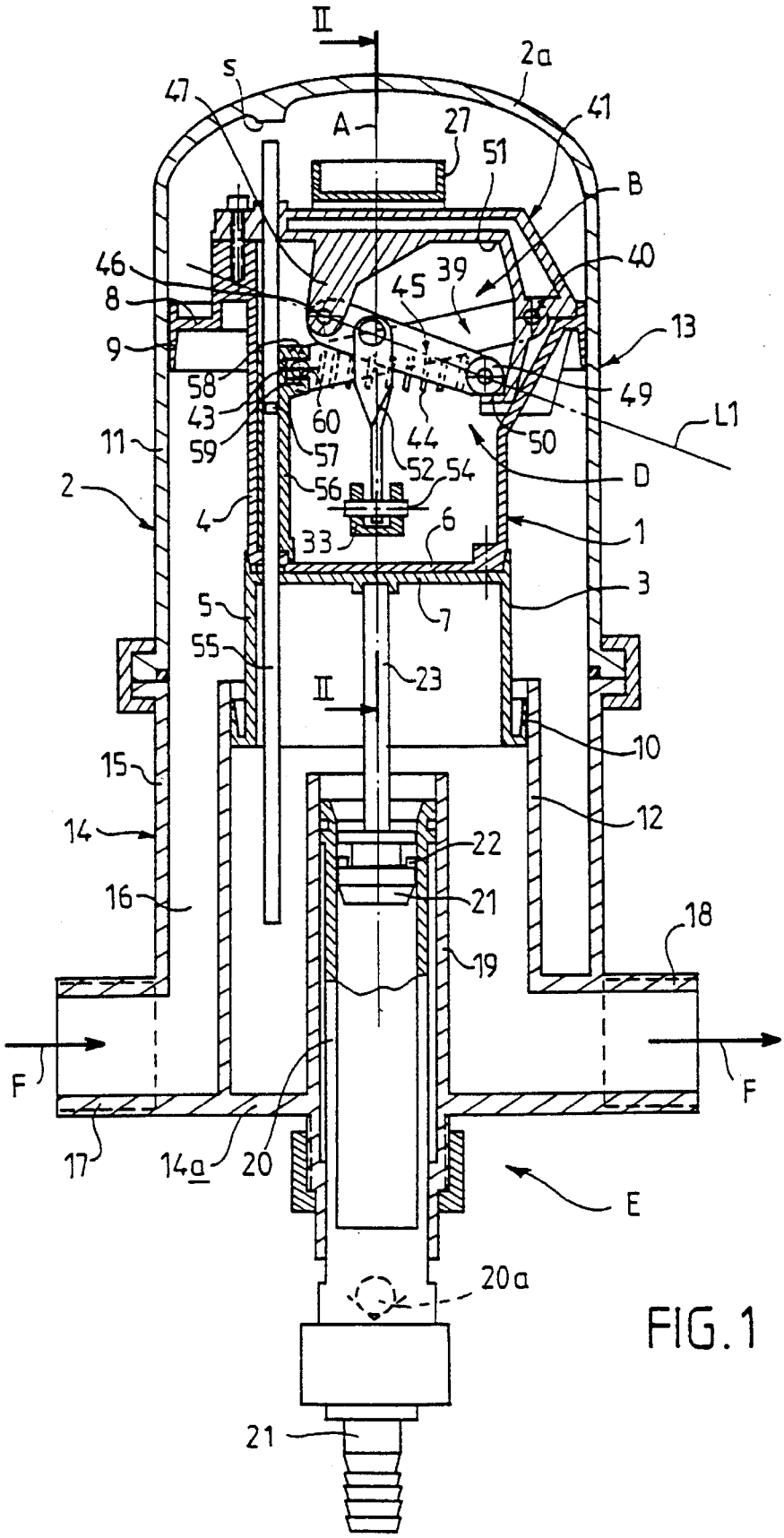

Referring to the drawings, particularly to FIG. 1, a device D can be seen for controlling the reciprocating displacements of a differential piston 1 capable of being displaced in an enclosure 2 belonging to a metering pump assembly E capable of injecting an additive into a driving fluid flowing in the direction of the arrows F of FIG. 1.

The differential piston 1 comprises a cylindrical body 3 produced in two portions 4, 5 pointing in opposite directions and joined base to base, particularly by screws which have not been represented. The portion 4 has its open end pointing towards the cover 2*a* of the enclosure 2, whereas the portion 5 has its open end pointing in the opposite direction.

The piston 1, therefore includes two parts where the cross-section differs from each other. An upper part is situated above the base 6 and a lower part is situated below base 7. The total cross-sectional area of the upper part equals the sum of the surface areas of the collar 8 and of the base 6, with the diameter being equal to the outside diameter of the collar 8. The diameter of the lower part equals the outside diameter of the skirt 10 and is smaller than that of the upper part.

The enclosure 2 includes two cylinders 11, 12 associated respectively with each part of the piston. The cylinder 11 has a larger diameter and the skirt 9 slides in leaktight fashion against the internal surface of this cylinder 11. The cylinder 12 has a smaller diameter and the skirt 10 slides in leaktight fashion against the internal surface of this cylinder.

The enclosure 2 is produced in two parts, namely an upper part 13 comprising the cylinder 11 and the cover 2*a* and a lower part 14 comprising the cylinder 12 of smaller cross-section and an outer casing 15 having the same diameter as the cylinder 11. An annular chamber 16 is defined between the external surface of the cylinder 12 and the casing 15. A fluid inlet 17 communicates with the chamber 16. An outlet 18 of the fluid is provided in the form of a nozzle connected to the inside space of the cylinder 12 and passing, without communication, through the chamber 16. The cylinder 11 includes, at its lower part, a radial collar applied and held in leaktight fashion, by appropriate mechanical means, against a collar provided at the upper end of the casing 15. The axial extent of the cylinder 12 is limited, in practise, to the plane where the casing 15 and the cylinder 11 are joined together.

The lower part 14 furthermore includes, inside the cylinder 12, a coaxial tubular element 19 of smaller diameter passing through the base 14*a* of the part 14.

A pump body 20 is mounted in the tubular element 19; a non-return valve 20*a* is provided at the bottom part of the body 20. A connection end-fitting 21 is provided at the lower part of the body 1 for the connection of a hose (not represented) intended to dip into a receptacle containing an additive to be injected into the liquid. A plunger 21 forming a piston and fitted with a seal 22 forming a valve, is mounted so that it slides in the pump body 20. The plunger 21 is connected by a rod 23 to the base 7 so as to be driven by the differential piston 1.

Figure 2:
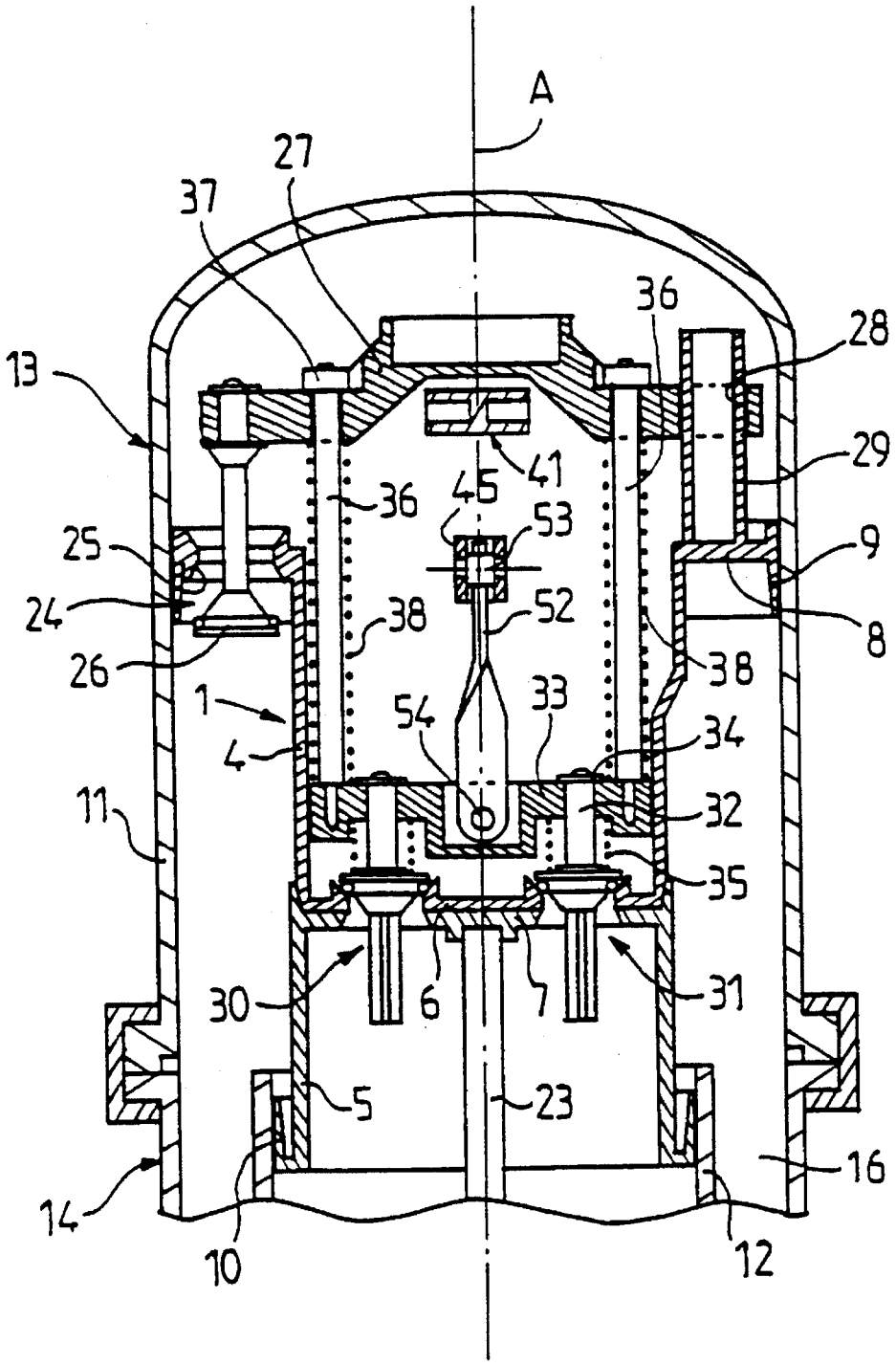
FIG. 2 is a partial section on the line II—II of FIG. 1, some elements, particularly of the rocker mechanism, not being represented in order to simplify.

The device D for controlling the displacements of the piston 1 comprises a first valve 24 (or valve assembly) visible in FIG. 2, associated with the part of large cross-section of the piston 1. The seat 25 of the valve 24 is provided in the collar 8, whereas the shutter 26 of the valve is supported by a sort of crossmember 27, the central part of which is substantially in the shape of an inverted V; the crossmember 27 extends substantially diametrally. The closure of the valve 24 is obtained by an upward movement of the cross-member 27 which applies the shutter 26 against the seat 25; the opening of the valve 24 is obtained by a reverse, downward movement, which moves the shutter 26 away from the seat 25 as far as the open position illustrated in FIG. 2. In the example represented, the end of the crossmember 27 diametrically opposite the valve 26 includes a bore 28 in which a cylindrical guide element 29, parallel to the axis of the enclosure and secured to the piston 1, is engaged.

Two diametrically opposite valves 30, 31 (FIG. 2) are provided in the part of smallest cross-section of the differential piston 1, that is to say on the bases 6 and 7. The seat of each valve is provided on the base 6 whereas the shutter of the valve is applied in leaktight fashion against the seat during a downward movement and moves away from the seat, in order to open the valve, during an upward movement. The shutter of each valve 30, 31 is equipped with a rod 32 mounted so that it slides in a transverse support 33 (FIG. 2) extending along a diameter of the portion 4. The ends of the rods 32 situated on the side of the support 33 opposite the base 6 are equipped with abutment heads 34 of a diameter greater than the bore via which the rod 32 passes in the support 33. A coil compression spring 35 is provided between the valve shutter and the support 33 in order to exert a force capable of elastically applying the head 34 against the support 33. The springs 35 make it possible simultaneously to produce primary sealing on both valves 30, resolving the problems of static redundancy. The means for connection between the shutters of the valves 30, 31 and the support 33 are, in some ways, telescopic connection means with elastic return, or elastic compensation means.

The support 33 is also connected by elastic means with telescopic return to the crossmember 27 in order to form gear. The connection means comprise two rods 36, diametrically opposite, fixed to the support 33 at their lower end and passing freely, with sliding, through a bore in the crossmember 27. The end of the rods 36, situated on the side of the crossmember 27 opposite the support 33, is equipped with a head 37 of larger diameter capable of coming into unilateral abutment against the crossmember 27 under the action of a coil spring 38 surrounding each rod 36 and bearing against the cross-member 27 at one end and against the support 33 at the other end.

The gear formed by the assembly of the cross-member 27 and of the support 33 can be displaced between the position of FIGS. 1 and 2, in which the valves 30, 31 are closed whereas the valve 24 is open, and a position corresponding to FIG. 3 for which the valve 24 is closed and the valves 30, 31 are open.

A rocker mechanism B is provided to control the valves 24 and 30, 31 in closure or opening at each end of stroke in order to reverse the movement of the differential piston 1.

As visible in FIGS. 1 and 4, the rocker mechanism B comprises a first link rod means 39 articulated, at one end, to a transverse pivot 40 connected to the piston 1.

This first link rod means 39 comprises two parallel branches 39*a*, 39*b* (FIG. 4) far apart from one another so as to surround a component 41 in the shape of a portal frame, fixed to the piston 1 and extending substantially along a diameter above the open end of the piston 1. The pivot 40 passes through a bore 42 of geometric axis perpendicular to a plane passing through the axis A of the casing 2. The branches 39*a*, 39*b* are articulated to the ends of the pivot 40 which project on either side of the component 41.

The ends of the branches 39*a*, 39*b* away from the pivot 40 are connected by a cylindrical bar 43 parallel to the pivot 40.

Two helical tension springs 44 are situated on either side of the plane passing through the axis of the casing 2 and orthogonal to the pivot 40. One end of each spring 44 is fastened to the bar 43 and therefore to the corresponding end of the branches 39*a*, 39*b*.

A second link rod means 45 is articulated, at an end away from the first pivot 40, to a second pivot 46 mounted in a spur 47, projecting downwards, from the component 41. The second pivot 46 is situated in the plane orthogonal to the axis A, of the casing 2, which passes through the first pivot 40 or in the vicinity of this plane. The second link rod means 45 is also formed by two parallel branches 45*a*, 45*b* which are less far apart, located between the springs 44 and the branches 39*a*, 39*b*, with the same midplane. The spur 47 has a small thickness and becomes housed between the branches 45*a*, 45*b*.

The branches 45*a*, 45*b* are connected, at their other end situated on the side of the first pivot 40, by a bar 48 projecting on either side of the branches. The other end of the springs 44 is fastened to the cylindrical bar 48 in the vicinity of its ends. A bearing piece 49, in the form of a washer, is mounted on the bar 48, between the branches 45*a*, 45*b*. The diameter of this component 49 is sufficient for its outline to extend slightly beyond the outline of the ends of the branches 45*a*, 45*b*.

The link rod 45 can oscillate between two angular positions represented respectively in FIG. 1 and in FIG. 3. In the low position of FIG. 1, the component 49 is bearing against an abutment surface 50 of the component 41 situated lower than the pivot 46. In the top position represented in FIG. 3, the component 49 is bearing against an upper abutment surface 51 also provided on the component 41 and situated above the pivot 46. The two limit stops 50, 51 are symmetrical, or substantially symmetrical with respect to the plane passing through the pivot 46 and orthogonal to the axis A.

A connecting member 52, the midline of which extends substantially along the axis A of the casing 2, is articulated on a spindle 53 carried by the branches 45*a*, 45*b*. The lower end of the connection member 52 is articulated on a spindle 54 carried by the support 33. The spindles 53 and 54 are mutually orthogonal and the connection member 52 is advantageously made up of a flat plate, twisted in its midpart.

The rocker mechanism B furthermore comprises a push rod 55, formed by a rod parallel to the axis A of the casing, mounted so that it slides relative to the piston 1 and passing in leaktight fashion through the bases 6 and 7. The push rod 55 also passes through a bore provided in the component 41.

A sleeve 56, situated entirely in the body portion 4, is traversed by the push rod 55 to which it is connected, for example, by crimping at a groove 57 of the push rod. The sleeve 56 is in the vicinity of that wall of the body 4 which is diametrically opposite the pivot 40. At its upper end, the sleeve 56 includes two radial extensions inwards 58, 59 delimiting, between them, a housing 60 which is radially open inwards. The upper and lower surfaces bounding this housing 60 are plane, parallel, orthogonal to the axis A.

The cylindrical bar 43 is engaged in this housing 60 and can come to rest simply by one generatrix either against the upper face or against the lower face of the housing 60. The bar 43 may be displaced totally freely with respect to the sleeve 56 in a direction orthogonal to the axis A during the rocking of the link rod means 39.

The assembly is laid out so that, in the low position illustrated in FIG. 1, the housing 60 is below the line L1 which passes through the axis of the pivot 46 and the axis of the roller 49 in the bottom position, that is to say bearing against the unit stop 50.

In the top position, the housing 60 is above the line L2 passing through the axis of the pivot 46 and the axis of the component 49 in its top position, that is to say bearing against the surface 51 (FIG. 3).

The operation of the control device and of the rocker mechanism B is as follows.

It is assumed that the starting position is that of FIG. 1 for which the piston 1 is in the vicinity of its top position and the second link rod means 45 is in its bottom position, as well as the support 33. As illustrated in FIG. 2, the valves 30 and 31 are closed whereas the valve 26 is open.

The driving fluid arriving through the pipe 17 passes through the valve 24 and exerts its action above the piston 1 over the entire cross-section of the cylinder 11. The piston 1, subjected to this pressure, descends, delivering through the outlet 18 the liquid from the cylinder 12 closed by the body portion 5 which descends with the piston 1.

Simultaneously, the plunger 21 descends in the body 20 and the liquid trapped in the body 20 by the lower non-return valve 20*a* flows around the piston 21 via the valve-seal 22 in order to mix itself with the driving fluid.

Before the piston 1 arrives at the bottom end of stroke, the lower end of the push rod 55 comes to bear against a limit stop made up, for example, by the base 14*a* of the part 14.

The push rod 55 is immobilized in terms of translation while the piston 1 continues its descent. This results in a relative sliding movement between the push rod 55 and the sleeve 56 on the one hand, which are immobile relative to the enclosure 2, and the piston 1, on the other hand, which continues its descent.

During this phase, the bar 43 is immobilized, whereas the first pivot 40 continues to descend. The first link rod means 39 will rotate about the geometric axis of the pivot 40, in the clockwise direction according to the representation of FIG. 1, counter to the tension in the springs 44. The component 49 is still bearing against the bottom limit stop 50.

When, as a consequence of this relative movement, the bar 43 crosses the line L1, the force exerted by the springs 44 passes to the other side of the line L1, which causes the second link rod means 45 to rock abruptly from the bottom position of FIG. 1 to the top position of FIG. 3 under the tension of the springs 44. The cross-member 27 is raised, and with it the support 33. The valve 24 closes, whereas the valves 30, 31 open.

It should be noted that if the stroke of the connecting member 52 driving the support 33 is greater than the closure stroke of the valve 26, this is not an impediment because, when the shutter 26 has come to bear against the seat 25, the support 33 can continue its stroke, compressing the springs 38. A similar remark applies to the closure of the valves 30, 31, of which the springs 35 may be compressed by the support 33 during closure.

The driving fluid exerts a pressure under the surface of the collar 8 whereas the space situated on the other side of this collar is in communication, via the open valves 30, 31, with the outlet 18.

The piston 1 will therefore reverse its stroke and come back up, driving the plunger 21 which sucks up a dose of additive into the pump body 20, the valve seal 22 being leaktight for a displacement in this direction.

At the end of the top stroke, the push rod 55 will come to bear against the part s (FIG. 1) of the cover 2*a* of the casing 2, whereas the piston 1 continues its upwards stroke. A relative downward movement of the sleeve 56 and of the bar 43 relative to the pivot 40 will result therefrom. When the bar 43 has crossed the line L2 (FIG. 3), the tension in the springs 44 will cause the second link rod means 45 to rock about the second pivot 46. The roller 49 will abruptly pass from the upper rest 51 to the lower rest 50. The support 33 will descend and the valves 30, 31 will close whereas the valve 24 will open.

We are then back in the configuration which allows the movement of the piston 1 to be reversed, and it to descend.

It appears that the transverse forces created by the spring 44 are taken up internally by the rocker mechanism B and are essentially absorbed by the pivots 40 and 46 which are immobile with respect to the piston 1.

The connection between the bar 43 and the housing 60 transmits only forces which are parallel to the direction of sliding of the push rod 55 which is therefore not subjected to parasitic transverse forces. This results in very good sliding of the push rod 55 and of the sleeve 56 without any force which is detrimental as regards the sliding seal between push rod 55 and walls 6, 7.

An increase in the strength of the springs 44 makes it possible to increase the component parallel to the direction of displacement of the push rod 55 without creating an increase in parasitic forces. The assembly is highly insensitive to pollution of the water. The decrease in friction due to the reduction in parasitic forces reduces wear on the components.

The force exerted by the springs 44 on the push rod 55 is substantially constant, and even tends to decrease at the moment of triggering because the variation in extension of the springs 44 between the two stable positions is not very significant.

The force with which the valves are applied to their seat benefits from a lever effect created by the second link rod means 45.

We claim:

1. Device for controlling the reciprocating displacements of a differential piston including two parts of different cross-sections, this piston being capable of being displaced in an enclosure including two cylinders respectively associated with each part of the piston, the enclosure being equipped with an inlet for driving fluid connected to one of the cylinders and with an outlet connected to the other cylinder, the control device including at least one valve associated with each of the parts of different cross-sections of the piston, and a rocker mechanism (B) urged by a spring in a direction transverse to the direction of displacement of the piston, this rocker mechanism (B) being designed to control the valves in closure and/or opening at each end of stroke in order to reverse the movement of the piston, a push rod being mounted so that it slides relative to the piston whilst being able to be driven by this piston, the push rod being capable of coming to bear, at each end of stroke, against a limit stop connected to the enclosure, in order to give rise to the rocking of the mechanism, the rocker mechanism (B) being arranged in order to provide internal uptake of the transverse forces of the spring and in order to transmit to the push rod solely forces which are substantially parallel to the direction of displacement of this push rod, characterized by the fact that the rocker mechanism (B) comprises a first link rod means articulated at one end to a first pivot connected to the piston, the other end of this link rod means being connected to one end of the said spring, and a second link rod means, one end of which is articulated to a second pivot connected to the piston but situated at a distance, in a transverse direction with respect to the direction of sliding of the push rod, away from the first pivot, the other end of this second link rod means being connected to the other end of the said spring and being capable of rocking between two rests connected to the piston, situated on either side of the first pivot in the direction of sliding of the push rod.

2. Device according to claim 1, characterized by the fact that the two pivots are in one and the same plane orthogonal to the axis (A) of the casing.

3. Device according to claim 1, characterized by the fact that the rocker mechanism (B) is connected to the push rod by a simple rest means comprising, on the mechanism side, a bar substantially orthogonal to the direction of displacement of the push rod and, on the push rod side, a housing open in direction orthogonal to the direction of displacement of the push rod and capable of receiving the bar.

4. Device according to claim 3, characterized by the fact that a sleeve is fixed to the push rod, and the abovementioned housing is provided in this sleeve.

5. Device according to claim 3, characterized by the fact that the first link rod means comprises two parallel branches far apart from each other, between which branches is mounted the second link rod means, the ends of the branches away from the first pivot being connected by the bar engaged in the abovementioned housing, the spring being fastened, at one end, to the said bar and, at its other end, to another bar carried by the second link rod means.

6. Device according to claim 5, characterized by the fact that the second link rod means is formed by two parallel branches, which are less far apart than those of the first link rod means, the said branches, at their end away from the second pivot, carrying the bar to which the other end of the spring is fastened.

7. Device according to claim 6, characterized by the fact that the spring comprises two elementary springs, mounted in parallel between the branches of the first and of the second link rod means.

8. Device according to claim 1, characterized by the fact that the differential piston comprises a central part bounded by a cylindrical hollow portion and an annular part, and the pivots of the link rod means are carried by a component forming a sort of diametral portal frame, fixed to the upper part of the piston and including a bearing for each pivot.

9. Device according to claim 1, characterized by the fact that the valves are mounted on gear connected, by a linking member, to the second link rod means.

10. Device according to claim 9, characterized by the fact that elastic compensation means are placed between the valves and the parts of the gear driving these valves, so that the gear can benefit from a dead travel while the valve is in abutment in its closed position.

11. Metering pump capable of injecting an additive product into a liquid, and comprising a differential piston capable of actuating the plunger of a pump for the additive, said metering pump including a device for controlling the displacements of the piston, said device including two parts of different cross-sections, said piston being capable of being displaced in an enclosure including two cylinders respectively associated with an inlet for driving fluid connected to one of the cylinders and with an outlet connected to the other cylinder, the control device including at least one valve associated with each of the parts of different cross-sections of said piston, and a rocker mechanism (B) urged by a spring in a direction transverse to the direction of displacement of the piston, this rocker mechanism (B) being designed to control the valves in closure and/or opening at each end of stroke in order to reverse the movement of said piston, a push rod being mounted so that it slides relative to said piston, whilst being able to be drive by said piston, the push rod being capable of coming to bear, at each end of stroke, against a limit stop connected to the enclosure, in order to give rise to the rocking of the mechanism, the rocker mechanism (B) being arranged in order to provide internal uptake of the transverse forces of the spring and in order to transmit to the push rod solely forces which are substantially parallel to the direction of displacement of this push rod, characterized by the fact that the rocker mechanism (B) comprises a first link rod means articulated at one end to a first pivot connected to said piston, the other end of this link rod means being connected to one end of the said spring, and a second link rod means, one end of which is articulated to a second pivot connected to said piston but situated at a distance in a transverse direction with respect to the direction of sliding of the push rod, away from the first pivot, the other end of this second link rod means being connected to the other end of the said spring and being capable of rocking between two rests, connected to said piston situated on either side of the first pivot in the direction of sliding of the push rod.

12. Device according to claim 2, characterized by the fact that the rocker mechanism (B) is connected to the push rod by a simple rest means comprising, on the mechanism side, a bar substantially orthogonal to the direction of displacement of the push rod and, on the push rod side, a housing open in direction orthogonal to the direction of displacement of the push rod and capable of receiving the bar.

13. Device according to claim 4, characterized by the fact that the first link rod means comprises two parallel branches far apart from each other, between which branches is mounted the second link rod means, the ends of the branches away from the pivot being connected by the bar engaged in the above mentioned housing, the spring being fastened, at one end, to the said bar and, at its other end, to another bar carried by the second link rod means.

* * * * *

UNITED STATES PATENT AND TRADEMARK OFFICE

CERTIFICATE OF CORRECTION

PATENT NO. : 5,505,224
DATED : April 9, 1996
INVENTOR(S) : Urrutia et al.

It is certified that error appears in the above-identified patent and that said Letters Patent is hereby corrected as shown below:

Column 3, line 1, please insert the following paragraph:

---The portion 4 includes, towards its open end, an annular collar 8 projecting radially and equipped on its peripheral edge with a skirt 9 constituting a sealing lip extending essentially from the opposite side from the cover 2a. The portion 5 of the piston body includes, at its lower end, a sealing skirt 10 pointing towards the collar 8. The skirt 10 has a smaller diameter than that of the skirt 9, the two skirts being coaxial with the enclosure 2.---

Signed and Sealed this

Seventeenth Day of September, 1996

*Attest:*

*Attesting Officer*

Bruce Lehman

BRUCE LEHMAN

*Commissioner of Patents and Trademarks*